US007308978B2

(12) United States Patent
Matheisl

(10) Patent No.: US 7,308,978 B2
(45) Date of Patent: Dec. 18, 2007

(54) DRIVE EQUIPMENT FOR ESCALATOR STEP OR MOVING WALKWAY PLATE

(75) Inventor: Michael Matheisl, Vienna (AT)

(73) Assignee: Inventio AG, Hergiswil (CH)

( * ) Notice: Subject to any disclaimer, the term of this patent is extended or adjusted under 35 U.S.C. 154(b) by 136 days.

(21) Appl. No.: 10/896,094

(22) Filed: Jul. 20, 2004

(65) Prior Publication Data

US 2005/0034958 A1 Feb. 17, 2005

(30) Foreign Application Priority Data

Jul. 31, 2003 (EP) ..... 03405569

(51) Int. Cl.
*B66B 21/02* (2006.01)

(52) U.S. Cl. ..... 198/330; 198/321

(58) Field of Classification Search ..... 198/321, 198/330–333; 104/288
See application file for complete search history.

(56) References Cited

U.S. PATENT DOCUMENTS 4,090,452 A * 5/1978 Segar ..... 104/247
5,595,121 A * 1/1997 Elliott et al. ..... 104/53
6,418,855 B1 * 7/2002 Fischer ..... 104/118
2002/0175040 A1 11/2002 Postlmayr

FOREIGN PATENT DOCUMENTS

DE 19606861 A1 * 8/1997
DE 198 37 915 A1 3/2000
JP 2000198659 A * 7/2000
JP 2001 163 562 6/2001

* cited by examiner

*Primary Examiner*—Mark A Deuble
(74) *Attorney, Agent, or Firm*—Schweitzer Cornman Gross & Bondell LLP

(57) ABSTRACT

An escalator or moving walkway has a step or plate belt with motor-driven steps or plates and free-running steps or plates. A drive frame connected with a frame serves as support for a drive unit of a motor-driven step or plate. The drive unit includes a motor, a transmission and a brake. A friction wheel, which transmits drive power to a travel track, is arranged at the transmission output, while a counter-pressure roller arranged in a fixed position on the drive frame laterally guides the step.

8 Claims, 3 Drawing Sheets

DRIVE EQUIPMENT FOR ESCALATOR STEP OR MOVING WALKWAY PLATE

The present invention relates to an escalator or moving walkway having a support construction, a step belt with motor-driven steps and free-running steps or a plate belt with motor-driven plates and free-running plates for the transport of persons and/or articles and a balustrade mounted by means of a balustrade base, and having a handrail.

BACKGROUND OF THE INVENTION

An escalator has become known from laid-open specification JP 2001163562 in which the individual steps of the step belt are provided with a drive. The drive comprises an electric motor which is integrated in the step body and which at each side drives a leading and a trailing axle, wherein gearwheels arranged at ends of an axle engage stationary racks. The current feed for the electric motor takes place by means of power rails and wiper contacts.

The two gearwheels provided per step cause excessive noise when meshing with the racks. The step has to be precisely guided so that the gearwheels cleanly engage the racks. Moreover, such a drive mechanism with pulleys, belts or chains, axles, gearwheels and racks is mechanically complicated, expensive and high in maintenance. Problems with synchronism arise due to driven step rollers and driven chain rollers.

The present invention provides a remedy to the shortcomings of the prior art. It is accordingly a purpose of the present invention to avoid the disadvantages of the known equipment and to create drive equipment which, in a simple mode and manner, drives a step or a plate of, respectively, a step belt or a plate belt.

BRIEF DESCRIPTION OF THE INVENTION

In accordance with the foregoing and other objects and purposes, the present invention comprises a drive unit which transmits drive power to a travel track through a friction couple. The power transmission required for forward drive of the step or the plate takes place at a point which ensures that the step or the plate cannot be tilted by the drive. Only a few additional escalator or moving walkway parts are necessary for motorizing the steps or plates. The centrally arranged travel track for progression of the motor-driven step also serves as a brake rail for the brake provided for each motor-driven step.

BRIEF DESCRIPTION OF THE DRAWINGS

The invention is explained in more detail in the following on the basis of drawings showing an illustrative embodiment, in which.

DETAILED DESCRIPTION OF THE INVENTION

Figure 1:
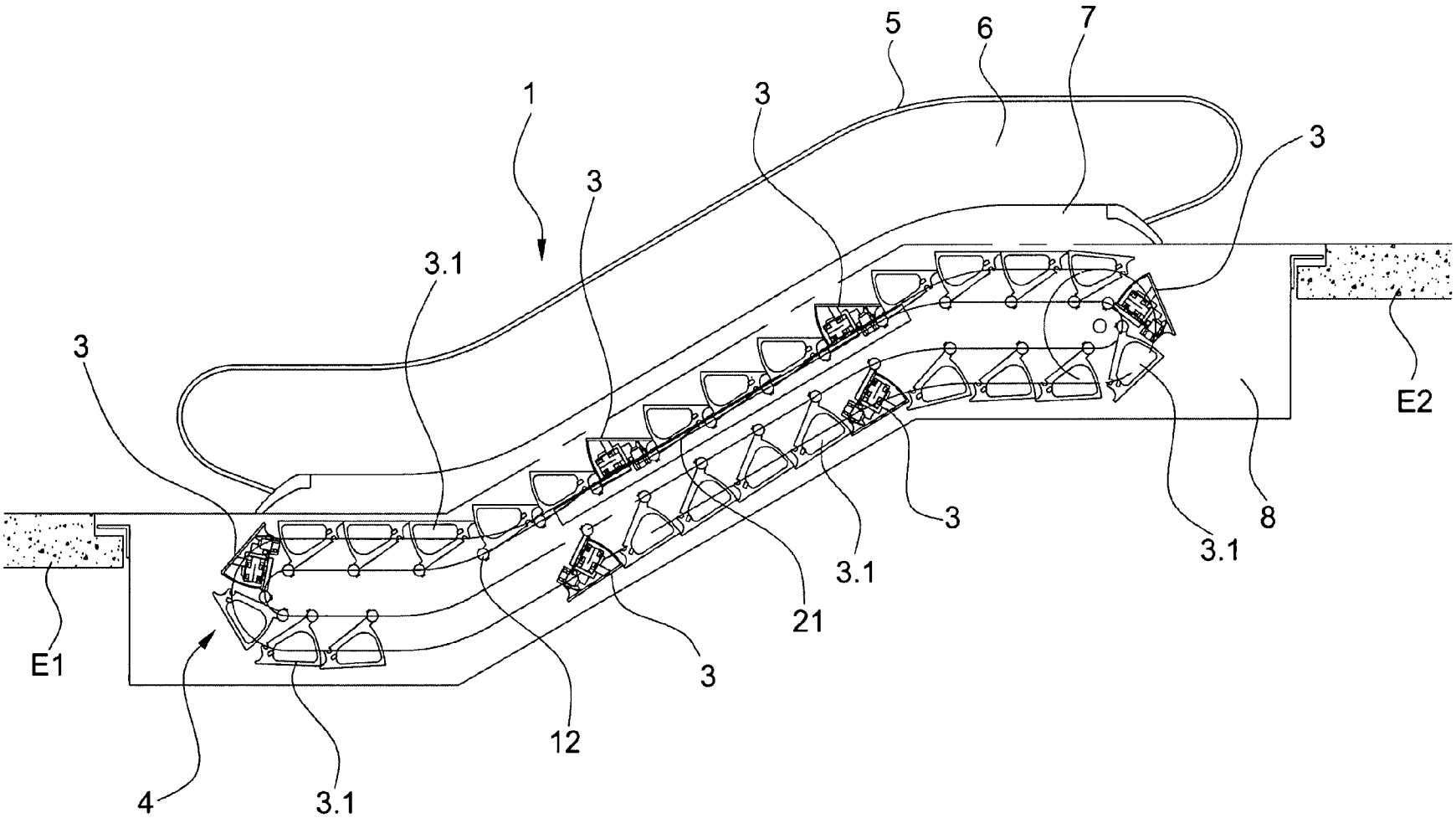
FIG. 1 shows a side view of an escalator incorporating the invention.

FIG. 1 shows an escalator 1, which connects a first floor E1 with a second floor E2, or a moving walkway, with a step belt 4 consisting of motor-driven steps 3 and free-running steps 3.1. It is to be recognized that an analogous construction is employed in the case of a moving walkway, wherein the references 3 and 3.1 refer to motor-driven and free-running plates, respectively. Depending on the respective escalator or moving walkway, a motor-driven step or plate 3 is provided for every four to twelve free-running steps or plates 3.1. A handrail 5 is arranged at a balustrade 6, which is mounted at the lower end by means of a balustrade base 7. The balustrade base 7 is supported by a support construction 8 of the escalator or moving walkway 1.

In the further course of description there is used, instead of the expression "escalator or moving walkway", merely "escalator", but the embodiments apply in like sense also to a moving walkway.

Figure 2:
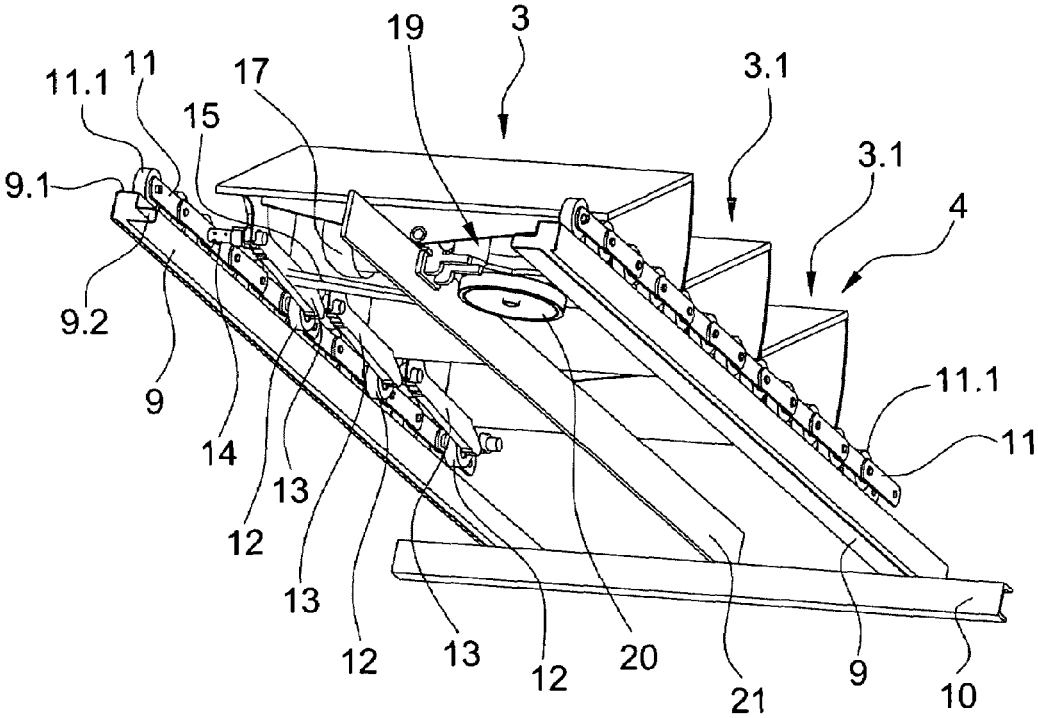
FIG. 2 shows a three-dimensional detail of a step belt with a motor-driven step and free-running steps.
Figure 3:
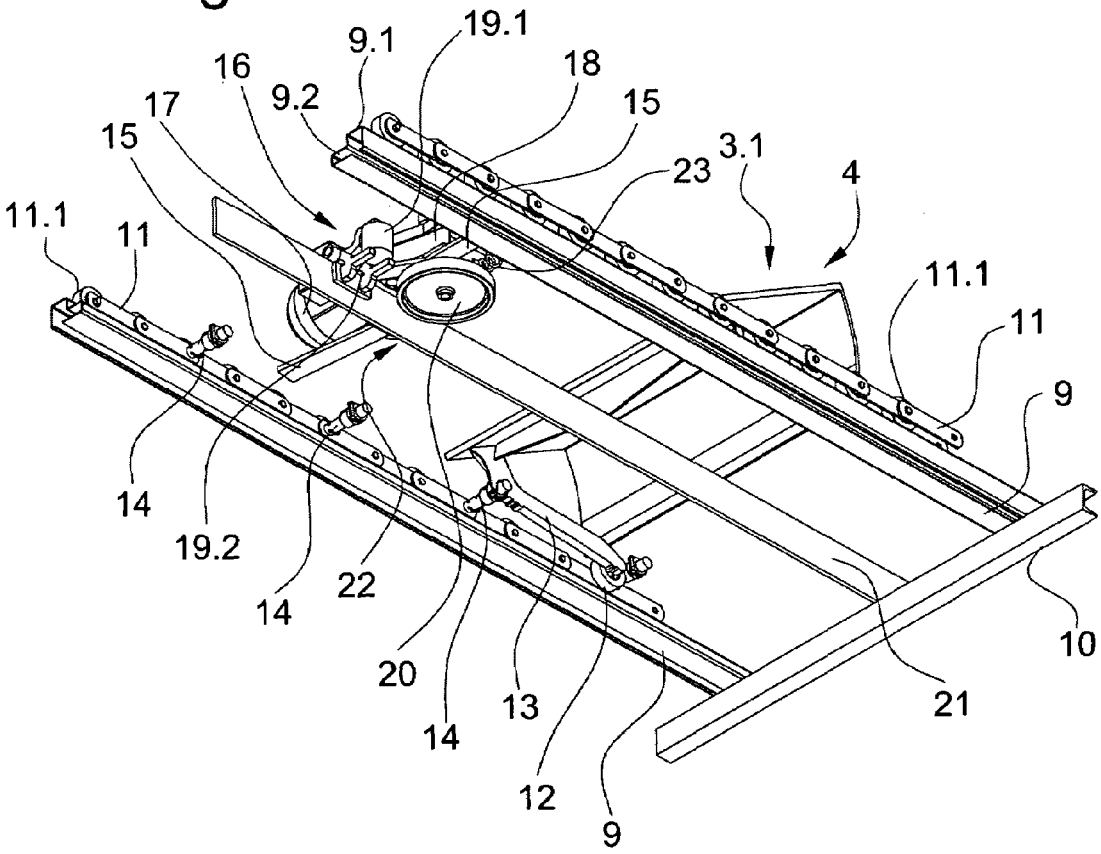
FIG. 3 shows the detail of FIG. 2 with the motor-driven step with step bodies not shown for clarity.

FIGS. 2 and 3 show, in three-dimensional detail, the step belt 4 with a motor-driven step 3 and free-running steps 3.1. Guide rails 9 are supported by a support 10 of the support construction 8. Each guide rail 9 has a running surface 9.1 for guidance of chain rollers 11.1 of a step chain 11, and a running surface 9.2 for guidance of step rollers 12 of the steps 3 and 3.1. Each step 3 and 3.1 comprise a step frame 13 which is connected with the step chain 11 by means of step bolts 14. The step rollers 12 are also arranged at the step frame 13.

A drive frame 15 connected with the step frame 13 serves as support for a drive unit 16 of the motor-driven step 3, wherein the drive unit 16 has a motor 17, a transmission 18 and a brake 19. The transmission 18 is arranged at a step pin 15.1. A friction wheel 20, which transmits the drive power by a friction couple to a travel track 21, is provided at the transmission output, wherein a counter-pressure roller 22, arranged in a fixed position at the drive frame 15, laterally guides the step 3. In order to ensure a constant drive power transmission, the friction wheel 20 is permanently pressed against the travel track 21 by means of a presser spring 23.

The brake 19 consists of a brake magnet 19.1 which releases brake pincers 19.2 to overcome a spring force. In the case of a stop, emergency stop or unallowed downward movements of the step belt 4, the brake pincers 19.2 engage, under spring loading, the travel track 21.

Figure 4:
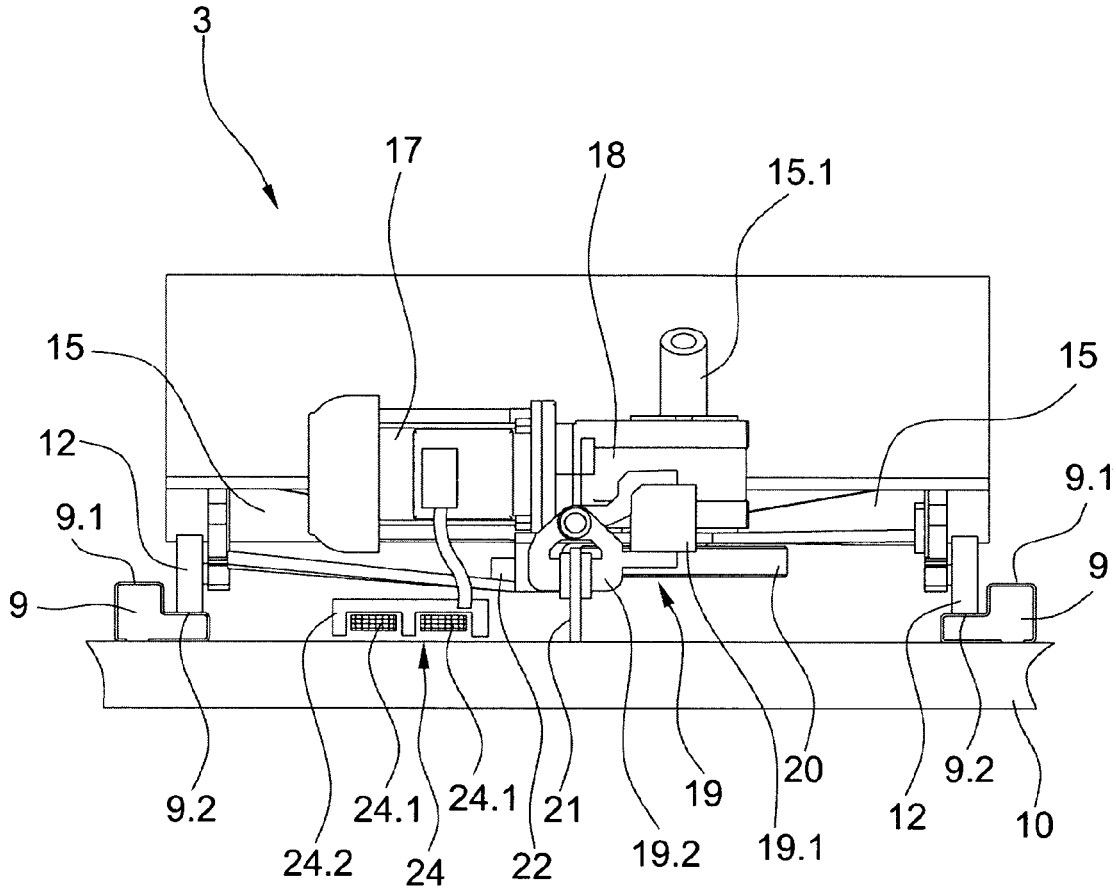
FIG. 4 shows the motor-driven step with current supply means.

FIG. 4 shows the motor-driven step 3 with a current supply means 24 along the travel track 21 in the inclined forward running part of the escalator 1. In the illustrated embodiment the current supply is ensured by means of contactless, inductive energy transmission. A pair of stationary primary parts 24.1 induce energy in secondary part 24.2 which travels with the step 3 and to which the motor 17 and the brake magnet 19.1 are connected. Control signals are transmitted by radio to or from the step 3.

The current supply can also be provided and ensured by means of wiper contacts or brushes guided along a power rail.

I claim:

1. A conveying device for persons in the form of an escalator or moving walkway comprising a support construction with a pair of spaced guide rails extending along opposite sides of the conveying device and a single travel track independent from and centrally located between and spaced from said guide rails, each of the guide rails having an chain roller running surface and a separate parallel step roller running surface, a belt construction for the transport of persons and/or articles with a drive unit for transmitting drive power through a friction couple to the travel track and having a step chain with continuously freewheeling chain rollers for supporting the belt construction upon the chain roller running surfaces and continuously freewheeling step rollers for supporting the belt construction upon the step roller running surfaces of the guide rails, and a balustrade mounted to the support construction by means of a balustrade base and having a handrail, the drive unit comprising a motor, a transmission coupled to the motor, a friction wheel at an output of the transmission to transmit the drive power to the travel track, and a brake unit independent from the friction couple, friction wheel and motor.

2. The conveying device according to claim 1, characterized in that the brake has brake pincers to engage the travel track.

3. The conveying device according to claim 1, characterized in that a current supply means is arranged along the travel track.

4. The conveying device according to claim 2, characterized in that a current supply means is arranged along the travel track.

5. The conveying device according to claim 4, characterized in that the travel track is located at an inclined forward run part of the conveying device.

6. The conveying device according to claim 2, characterized in that the travel track is located at an inclined forward run part of the conveying device.

7. The conveying device according to claim 1, characterized in that the travel track is located at an inclined forward run part of the conveying device.

8. The conveying device according to claim 1, characterized in that the drive unit is mounted to a drive frame, and a counter-pressure roller is also arranged at the drive frame to engage the travel track.

* * * * *